United States Patent [19]

Adams et al.

[11] Patent Number: 4,923,117

[45] Date of Patent: May 8, 1990

[54] MICROCOMPUTER-CONTROLLED, SYSTEM WITH REDUNDANT CHECKING OF SENSOR OUTPUTS

[75] Inventors: Wilmer L. Adams, Fridley, Minn.; James I. Bartels, Hudson, Wis.; Robert A. Black, Jr., Brooklyn Park, Minn.; Kenneth B. Kidder, Coon Rapids, Minn.; William R. Landis, Bloomington, Minn.; Paul B. Patton, Rockford, Minn.

[73] Assignee: Honeywell Inc., Minneapolis, Minn.

[21] Appl. No.: 337,243

[22] Filed: Mar. 13, 1989

Related U.S. Application Data

[63] Continuation-in-part of Ser. No. 146,556, Jan. 21, 1988, abandoned.

[51] Int. Cl.[4] ..... F23Q 23/00

[52] U.S. Cl. ..... 236/94; 324/500; 340/650; 364/557; 431/24

[58] Field of Search ..... 236/94; 165/11.1; 364/551, 556; 340/650, 511; 324/500; 431/14, 24

[56] References Cited

U.S. PATENT DOCUMENTS

| | | | |
|---|---|---|---|
| 4,155,080 | 5/1979 | Kovacs | 324/500 X |
| 4,296,727 | 10/1981 | Bryan | 165/11.1 |
| 4,298,334 | 11/1981 | Clark et al. | 431/24 |
| 4,518,345 | 5/1985 | Mueller et al. | 431/24 |
| 4,716,519 | 12/1987 | Locke, Jr. et al. | 364/557 X |
| 4,716,858 | 1/1988 | Bartels | 236/14 X |

*Primary Examiner*—William E. Wayner
*Attorney, Agent, or Firm*—Edward Schwarz

[57] ABSTRACT

A burner control system has a microprocessor for testing parameters of operation and for indicating deviations from a preset range for each. The sensors monitoring the parameters provide their outputs as analog voltages to analog to digital (A/D) converters which provide the parameters in digital form. Tests using preset voltage standards increase the likelihood of A/D converter accuracy. In addition, as operating conditions for the burner change, different preset ranges are used for each sensor output when testing them so as to provide maximum confidence of proper burner operation.

14 Claims, 6 Drawing Sheets

Fig. 1
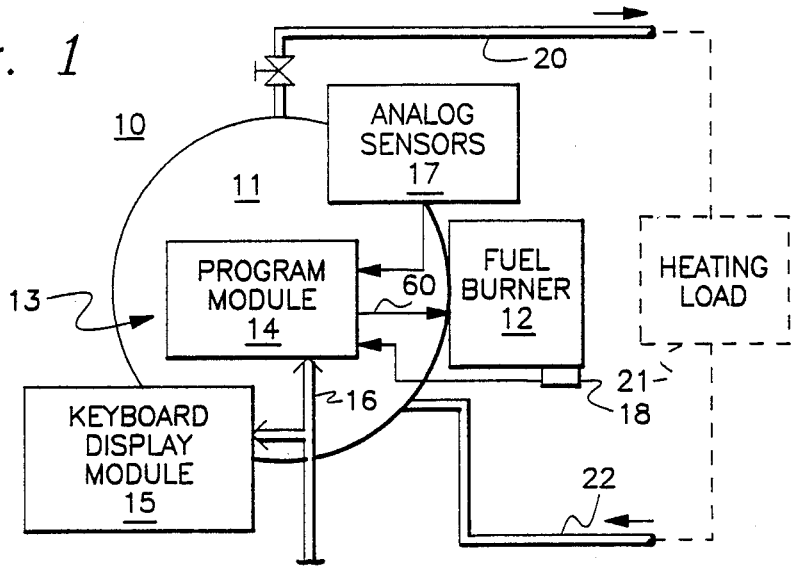
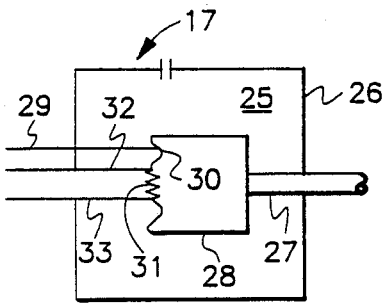
Fig. 2
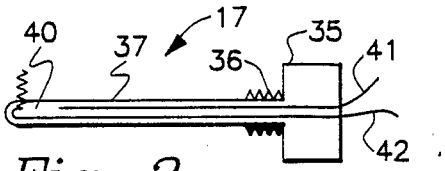
Fig. 3
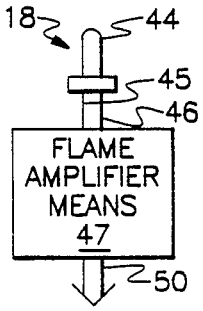
Fig. 4
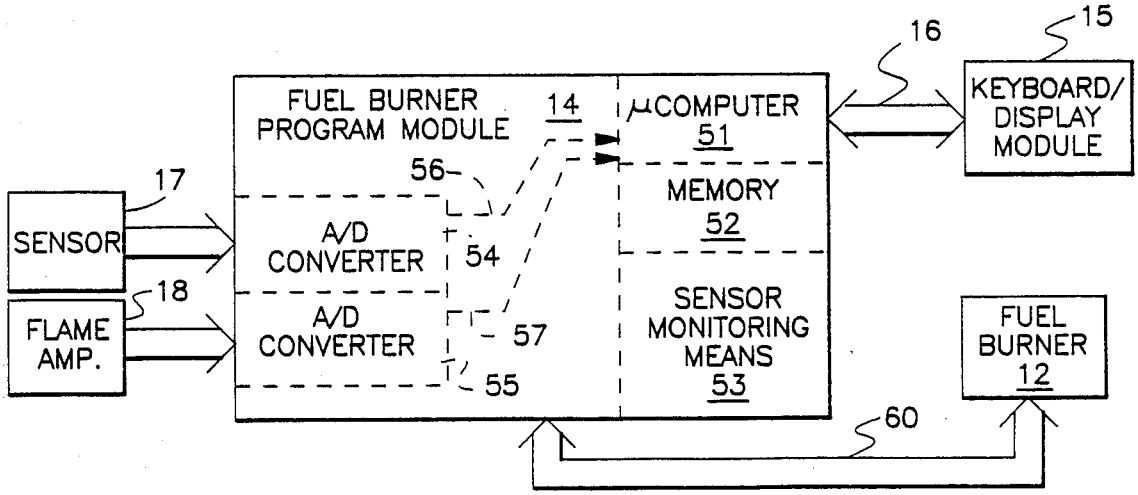
Fig. 5

MICROCOMPUTER-CONTROLLED SYSTEM WITH REDUNDANT CHECKING OF SENSOR OUTPUTS

This is a continuation-in-part application of the application having Ser. No. 07/146,556, now abandoned and filed on Jan. 21, 1988 by Wilmer L. Adams, James I. Bartels, Robert A. Black, Jr., and William R. Landis, and entitled Fuel Burner Control System with Analog Sensors.

BACKGROUND OF THE INVENTION

Fuel burner control systems, or systems that are commonly referred to as flame safeguard control systems, have been used for many years in nonresidential type burner control applications. These devices traditionally have been devices that operate through mechanical switches and relays. Since mechanical switches and relays provide "on-off" type of control or "go" or "no-go" functions the sensors used with the systems have been compatible switching type devices. These devices have been pressure operated, temperature operated, or flame operated. The sensor function would be to either provide an open or closed circuit.

This type of sensor structure has two significant faults. First, the sensor is incapable of providing ongoing information and is limited only to providing information as to a switched or limit condition. Secondly, this type of device is susceptible of being bypassed by users and maintenance people. Maintenance people traditionally jumper or open circuit sensors while troubleshooting. This type of troubleshooting can lead to serious and often unsafe conditions. Also, the ability to either short circuit or open circuit a sensor makes a system susceptible to being operated in an unsafe condition either intentionally or inadvertently by a person unaware of the risks involved.

SUMMARY OF THE INVENTION

In recent years, microcomputer based flame safeguard or fuel burner control systems equipment have been marketed. These devices have the intelligence to be operated in a more meaningful way than their electromechanical predecessors. While this has been true, the widespread use of electromechanical and mechanical sensors and limits has carried over into the environment of computer based flame safeguard equipment.

Since computer based flame safeguard equipment is capable of responding to a range of sensed signals, it is now proposed that the sensors used with such equipment be converted to analog type sensors. These sensors would be typically variable resistance, variable voltage or variable current output devices that are responsive to pressure, temperature, or flame intensity. With an analog signal available, the more intelligent microprocessor or computer based equipment can convert the analog information into a complete range of digital signals. The digital signals can then be compared against preselected valid ranges of signals. This provides an analog sensing arrangement that has three distinct advantages.

The first distinct advantage is the ability to obtain continuous readouts of the analog value by the analog to digital converter and the use of the microcomputer based flame safeguard device with an appropriate display. Such displays are alphanumeric displays that would be capable of providing a complete range of readouts of various analog sensed signals in a flame safeguard or fuel burner control system.

The second advantage, and one which has a major safety implication, is the use of a preselected range of acceptable values with a microcomputer based system that has memory and a monitoring system to ensure that the range is adhered to. This would discourage the short circuiting or open circuiting of analog type sensors because the fuel burner control system will respond to shut down the fuel burner in a safe manner. This would discourage service personnel and others from intentionally short circuiting or open circuiting the sensors during any troubleshooting activities, or interfering with any of the sensors in an attempt to operate a system that otherwise should be repaired.

The third advantage is the microcomputer's ability to test the analog-to-digital conversion at more input values than just the limit values of the sensor ranges, and to accomplish these tests in a manner that does not interfere with boiler operation. These additional input values include preselected intermediate values of the converter range. In addition, the use of two analog-to-digital converters allows their being tested against each other to provide a measure of redundancy in this self-checking procedure. Since fuel burner control systems are responsible for safe burner operation, special care must be taken to ensure the accuracy of electronic analog sensor systems that replace electromechanical sensors and limit controls. This special care includes both hardware and software techniques.

Thus, this invention is for use in a control system for providing a control signal for controlling the activity of a physical device such as a fuel burner whose operating condition can be derived from the output of a plurality of sensors each sensing a preselected physical quantity associated with the device and each providing an analog voltage signal whose magnitude is indicative of the physical quantity sensed by it. In a first embodiment, this invention comprises improved apparatus for testing system elements for operation according to design requirements and for issuing an alarm signal responsive to operation outside of design requirements, including (a) first and second analog to digital converters, each having at least first and second multiplexed analog voltage input channels, the channels for each converter respectively having predetermined unique first and second addresses, and each converter receiving a sensor signal at its second channel, each said converter further receiving channel select signals in which are encoded channel addresses and supplying responsive to the channel select signal a digital output signal encoding the magnitude of the analog signal present at the channel whose address is encoded in the channel select signal;

(b) a first reference voltage source providing a voltage to the first and second converters, first input channels, said provided voltages having predetermined precise values; and (c) microcomputer means prestoring the digital value of the voltage provided by the first reference voltage source and which microcomputer means receives the outputs of the first and second converters, for during a first predetermined time providing to each converter a channel select signal encoding the predetermined first input channel address of each, for storing the output from each converter during the first predetermined time, for testing the output of each converter for agreement with the prestored value for the first source's voltage supplied to that converter, and for issuing the alarm signal responsive to failure of the prestored value of the voltage provided by the first reference voltage source to agree with the output of the first or second converter.

There is also a second embodiment for use in a control system for providing a control signal for controlling the activity of a physical device whose operating condition can be derived from the output of at least one sensor sensing a preselected physical quantity associated with the device and each sensor providing an analog voltage signal whose magnitude is indicative of the physical quantity sensed by it. In this embodiment, the improved apparatus for testing system elements for operation according to design requirements and for issuing an alarm signal responsive to operation outside of design requirements, includes (a) at least a first analog to digital converter having an analog voltage input channel receiving a sensor signal there at, said converter supplying a digital output signal encoding the magnitude of the analog signal present at the input channel;

(b) microcomputer means receiving the output of the converter and further digitally prestoring (i) first and second values respectively specifying predetermined lower and upper limits for the output from the first converter and (ii) narrower device operating condition-dependent lower and upper limits for the outputs from the converter, for testing the output of the converter to fall within both the range defined by the device operating condition-dependent lower and upper limits and the range defined by the first and second values, for issuing the alarm signal upon failure of either of the tests, and for issuing a control signal which is a function of the converter output signal otherwise.

BRIEF DESCRIPTION OF THE DRAWINGS

FIG. 1 is a block diagram of a fuel burner control system disclosed with a boiler;

FIGS. 2, 3, and 4 are disclosures of some analog type sensors;

FIG. 5 is a block diagram of a burner control system, and,

DESCRIPTION OF THE PREFERRED EMBODIMENT

Figure 6:
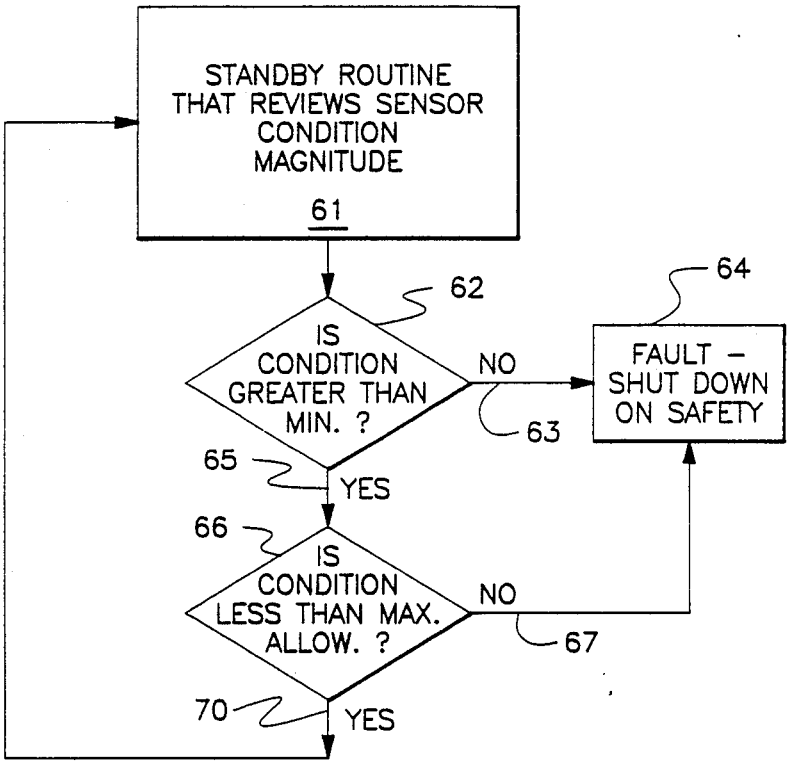
FIG. 6 is a flow chart of the safety checking feature.

In FIG. 1 a heating plant 10 is disclosed made up of a boiler 11 and a fuel burner 12 along with the necessary fuel burner control system generally indicated at 13. The fuel burner control system 13 is made up of a fuel burner program module means 14 and a keyboard and display module means 15. The keyboard and display module 15 is connected to the fuel burner program module means 14 by a communication bus 16 that ties the heating plant 10 to other, unrelated equipment. The fuel burner control system 13 is completed by the addition of analog sensors 17 and a flame detector 18 cooperating with the fuel burner 12.

The fuel burner 12, when in operation, generates sufficient heat in or at the boiler 11 to supply hot water or steam via a pipe 20 to a heating load 21 (that does not form part of the invention). The heating load 21 returns the water or steam condensate via a pipe 22 to the boiler 11 in a conventional manner. The fuel burner program module means 14 will be discussed in more detail in connection with FIG. 5. At this point, it is sufficient to state that the fuel burner program module means 14 contains a microcomputer, memory means, analog-to-digital converter means, and a sensor monitoring means. These means combine to provide the fuel burner program module means 14 with the capability of receiving signals from the analog sensors 17 and the flame detector 18. These signals are converted from an analog format to a digital format in analog to digital converters. The information is then utilized in the microcomputer means along with the sensor monitoring means to provide two functions that have not been available in previous equipment.

In FIGS. 2, 3, and 4, three different types of analog sensors are disclosed. In FIG. 2 a pressure responsive analog sensor 25 is provided. A housing 26 mounts a pressure responsive tube 27 to a housing 28 that is sealed by a diaphragm 30. Mounted on the diaphragm 30 is a solid state or strain gage type of sensor 31 that changes resistance with flexure of the diaphragm 30. The solid state sensor 31 has a pair of conductors 32 and 33 that can be used to connect the sensor to appropriate terminals (not shown) in the fuel burner program module means 14. A conductor 29 provides a fixed voltage to the sensor 31 and the sensor output is a variable voltage. The tube 27 is exposed to the pressure within the boiler 11 or some other similar situation for measuring fuel or steam pressure. The pressure is transmitted to the diaphragm 30 which is allowed to flex under changes of pressure. This flexure in turn changes the resistance of the element 31, and changes the output voltage available on conductors 32 and 33 so that an analog signal is provided to the fuel burner program module means 14.

In FIG. 3 a temperature responsive analog sensor is provided. A housing 35 is provided with a threaded mounting means 36 to insert a tube 37 into the boiler 11 in a fluid tight manner. Contained within the tube 37 is a temperature responsive resistor 40 which has a pair of leads 41 and 42 which project through the housing 35. Changes in temperature in the boiler 11 are sensed by the temperature responsive resistor 40, and its resistance varies. This variance is provided as an analog sensor signal to the program module means 14.

In FIG. 4 a flame detector 44 of a conventional ultraviolet type is disclosed. A pair of conductors 45 and 46 connect the sensor 44 to a flame amplifier means 47 that has an output at 50 that is a variable voltage signal in response to the magnitude of the flame sensed by the sensor 44. Once again, an analog type of output signal is available at 50 in response to a flame in the fuel burner 12.

In FIG. 5 a fuel burner program module means 14 is disclosed in some detail. This fuel burner program module means 14 utilizes a microcomputer 51 that has a memory 52 and a sensor monitoring means 53. Contained within the sensor monitoring means 53 there is stored preselected valid ranges of signals from different types of analog sensors. The information stored will depend on the particular application that can be readily understood as the storing of a preselected range of resistances for a pressure sensor, a preselected range of resistances for a temperature sensor, and a preselected range of currents for the flame amplifier means. This information allows the fuel burner control module 14 to appropriately respond to the requirements for operation of the fuel burner 12 under the control of the analog sensors 17 and 18.

In FIG. 5 there is further disclosed a pair of analog to digital converters 54 and 55. Analog-to-digital converter 54 is connected to the sensors 17 which could be either a pressure sensor or a temperature sensor as disclosed in FIGS. 2 and 3. The analog-to-digital converter 55 is connected to the flame amplifier means 47 and flame sensor 18. The system disclosed utilizes two analog-to-digital converters as a matter of safety. The requirements of the range of control for the output signal of the sensors 17 is normally different than the range of sensitivities or values for the output of the flame detector 18. By using two analog-to-digital converters 54 and 55 these differences can be readily handled within the fuel burner module means 14. It is noted that the analog to digital converter 54 is connected at 56 to the microcomputer 51, while the analog-to-digital converter 55 is connected at 57 to the microcomputer 51.

To complete the system, the microcomputer 51 is connected by the bus 16 to the keyboard and display module means 15, and by the bus or connection means 60 to the fuel burner 12. The keyboard and display module 15 typically would have both a keyboard for inputting information into the system, and an alphanumerical display, such as a liquid crystal display for the visual display of both input and output data. The keyboard and display module means 15 thus can continuously be provided with readings of the range of the analog signals from sensors 17 and 18, as well as other information, such as general status, annunciator information, faults and shutdown.

In FIG. 6 a flow chart is provided for the novel safety function within the present disclosure. A standby routine 61 is provided that continuously reviews the status of the sensor condition via the magnitude of the signal being presented. The continuous review can be normal upper and lower boiler operating limits, as well as the normal range of limits of the sensors. The analog value obtained by the standby routine 61 then is reviewed at 62 to determine if it is greater than the minimum of the preselected ranges involved. If it is not at 63, the system goes on to show a fault and the system shuts down at 64 in a safe manner.

If the evaluation at 62 indicates that the condition is greater than an established minimum, as indicated at 65, a further decision is made at 66. The decision at 66 is whether the condition is less than a maximum allowable condition. If it is not at 67, again the system shuts down on safety at 64. If the condition is within the allowed range at 70, the loop is closed back to the standby routine 61 where it is again run.

The operation of the sensor monitoring means 53 of FIG. 5 provides the continuous standby routine that review the sensor condition magnitude, and thereby ensures that the system is operating without an open circuited or short circuited analog sensor. The particular limits to which the system operates are preselected for the particular installation, type of sensors used, and other conditions needed to provide the heating plant 10 with proper operation. It is apparent that the microcomputer 51 is capable of supplying all types of status information to the keyboard and display module 15 to provide status information during a normal run, as well as trouble or annunciator information in the event of a fault and shutdown.

Figure 7:
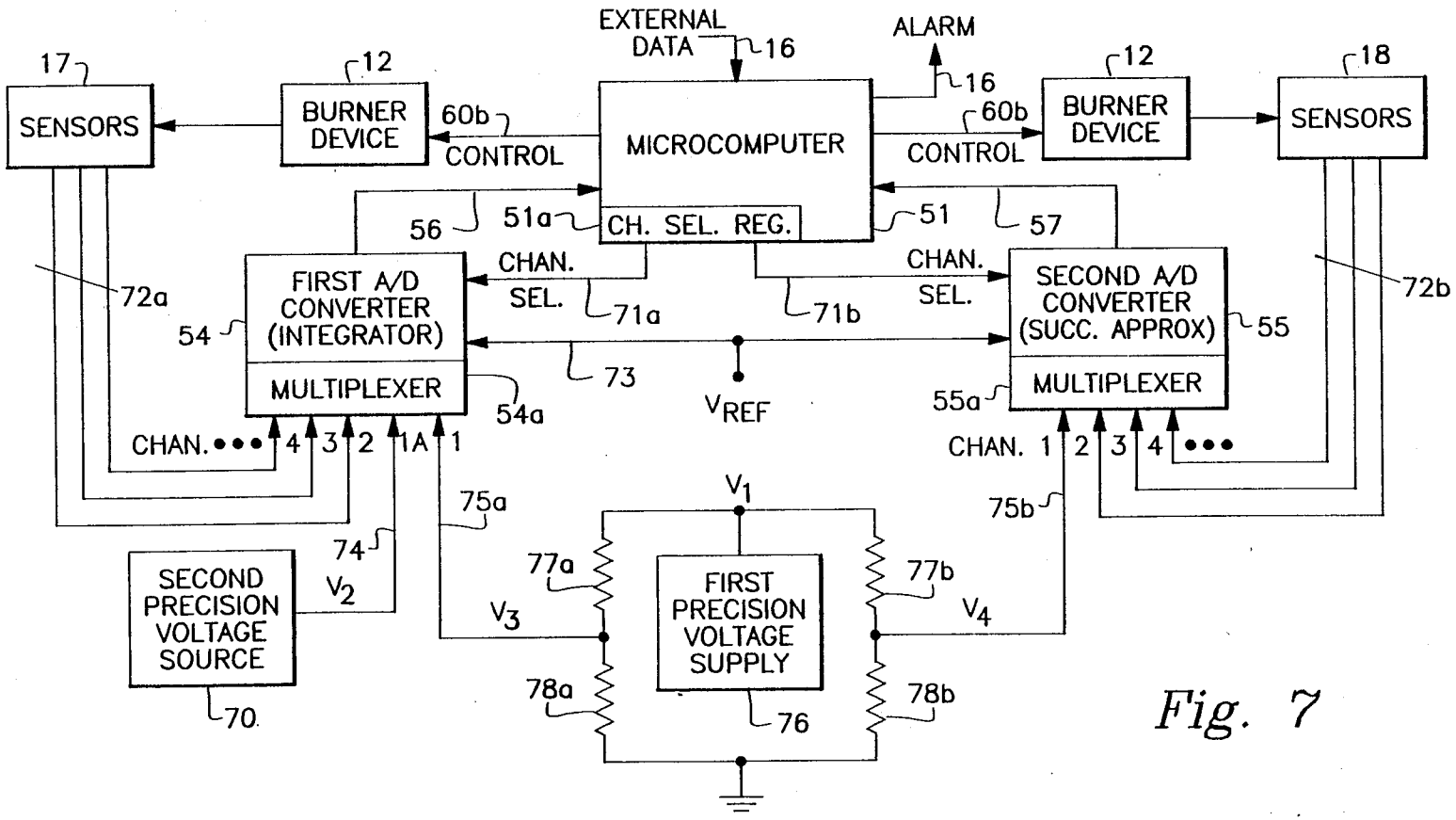
FIG. 7 is a detailed block diagram of the burner control system of FIG. 5.

The elements of FIG. 7 show more detail of the system of FIG. 5. Microcomputer 51 in FIG. 7 provides for the overall functioning of the system under control of a program whose relevant portions are shown in the flow diagram of FIGS. 8A, 8B, and 8C. Microcomputer 51 includes several output channels which are connected to channel select data paths **71*a* and 72*b* as well as to control paths 60*a* and 60*b* and alarm data path 16. Microcomputer 51 also includes input channels by which data presented on paths 56 and 57 from A/D converters respectively is accepted. In general, the data provided is loaded into the random access memory (RAM) of microcomputer 51. Microcomputer 51 also includes a channel select register 51*a* whose function will be described later. It should be understood that the RAM of microcomputer 51 includes a number of individual address locations which may function as such a register. Microcomputer 51 also includes apparatus permitting an operator to supply operating parameters directly on external data path 16, say by use of the keyboard 15 shown in FIG. 5**, or by plugging in a read-only memory (ROM) having the desired parameters prestored in it.

Accordingly, first and second analog-to-digital (A/D) converters 54 and 55 are provided to allow sensor 17 and 18 output values to be presented as digital data on paths 56 and 57 to microcomputer 51. For critical applications such as control of burner devices 12, it is important that the parameter values which define the performance of these burners be reported accurately and reliably to microcomputer 51. It is important, therefore, that first and second A/D converters 54 and 55 be highly reliable devices and further that failure or drift of either be promptly detectable. Therefore, a number of redundancies and self-checking capabilities are highly desirable. The accuracy of A/D converters 54 and 55 is based on a reference voltage $V_{REF}$ provided on path 73, and which must be accurately known and controlled to allow accurate analog-to-digital conversion. For the discussion following, assume that full scale output (all binary 1's) from a converter 54 or 55 corresponds to an input signal from a sensor or test voltage of 5.000 v.

A/D converters 54 and 55 are of the type having multiplexed inputs. Accordingly, first A/D converter 54 includes a multiplexer **54*a* shown having input channels with addresses 1–4 and 1A as illustrated although there may be more or less than these five, of course. Channel select path 71*a* receives address values from microcomputer 51 by which any desired one of these channels may be selected to furnish the analog voltage for conversion to the digital value. Converter 54 provides a digital signal on path 56 to microcomputer 51 which digital signal is the digital value of the analog voltage on the channel whose address is carried on channel select path 71*a*. It is typically the case that A/D converter 54 has an inherent delay between the time when a channel address is placed on path 71*a* and the digital value of the voltage applied to the channel selected thereby are first available. It is, therefore, possible that converter 54 includes apparatus for providing to microcomputer 51 a signal indicating the presence of the digital values at the time the digital values are first available, thereby allowing microcomputer 51 to perform other activities during this conversion interval. No further notice need be taken of these timing considerations. In addition to the predetermined precision voltages supplied on path 74*a* to converter 54, the sensors 17** provide their analog voltage signals on the group of paths 72*a* indicating the value of various operating parameters for burner device 12 with individual sensor outputs connected to individual channels of converter 54 having addresses 2, 3, 4, etc.

Second A/D converter 55 is entirely similar in function and performance to converter 54 in that it, too, has an input signal multiplexer 55*b* which can select from among its various input channels having addresses 1, 2, etc. accordingly as a channel address is provided by microcomputer 51 on channel select path 71*b*. Converter 55 has inputs from various sensors 18 on channels 2, 3, etc. via grouped signal paths 72*b*.

To accomplish one aspect of this invention, each converter 54 and 55 receives a predetermined precision test voltage at its respective channel 1 (first channel) on paths 75*a* and 75*b* respectively. It is convenient to supply the precision test voltages $V_3$ and $V_4$ carried on paths 75*a* and 75*b* by a voltage divider network which receives a voltage $V_1$ from the first precision voltage supply 76. The voltage divider network supplying $V_3$ on path 75*a* to channel 1 of first converter 54 in one preferred embodiment comprises a pair of resistors 77*a* and 78*a* which have relatively precise values of so as to create a precise voltage $V_3 = 3.765$ volts. Similarly, a precise voltage $V_4 = 2.500$ volts is supplied by the divider comprising precision resistors 77*b* and 78*b*. Voltage $V_4$ is supplied to channel 1 of second converter 55 on path 75*b*.

For redundancy and to ascertain a particular aspect of proper operation, a second voltage source 70 is used in this preferred embodiment to supply a second precision voltage $V_2 = 1.235$ volts to channel 1A of converter 54. Presence of a second precision voltage source for converter 54 provides additional capability for determining the proper operation, both of converter 54 and of precision voltage supply 76 and the divider network comprising resistors 77*a* and 78*a*.

The presence of the two precision voltage $V_2$ and $V_3$ inputs to converter 54 allows an additional check for proper converter operation. It is possible that an A/D converter may not properly function with respect to a particular binary digit position in its output. For example, converter 54 may have as a frequent failure mode a situation where one of the high order binary digits cannot assume one or the other of the binary values. If the five high order bits of the output on path 56 of converter 54 are reasonably expected to be error-free when digitizing a voltage provided to multiplexer 54*a*, then it is important to test that each of these high order bits can assume both 0 and 1 values. This capability can be tested by selecting the values of the components so that precision voltages $V_2$ and $V_3$ are such that preferably all of the high order bits of the digital values of $V_2$ whose accuracy may be assumed during proper operation are complements of the corresponding bits of the digital conversion of $V_3$. That is, the voltage $V_3$ is selected to have digits in a predetermined number of sequential high order digits which differ from those of the corresponding high order digits of the binary digit value of the voltage $V_2$. Typically, these converters have a predetermined full scale binary digital output which is all binary 1's. There will then be a sequence of consecutive high order binary 1's on the output path 6 corresponding to this predetermined full scale voltage level input. In this situation, the sum of $V_2$ and $V_3$ can be chosen to approximately equal the predetermined voltage level to which corresponds the full scale output of converter 54. It will be noted that the full scale output of converter 54, assumed to be 5.000 v., equals $V_2+V_3$ in the preferred embodiment described above. Given these conditions of full scale consecutive high order binary 1's for converter 54, then choosing the sum of voltages $V_2$ and $V_3$ to equal the full scale output value of converter 54 will automatically provide that the binary digital value of voltage $V_3$ is the complement in its high order bits of the corresponding high order bits of the binary digital value of the voltage $V_2$ provided by the second voltage source.

One preferred design choice of the structure shown in FIG. 7 is that first converter 54 have a structure for performing the analog-to-digital conversion different from that of second converter 55. That is, first converter 54 may have, for example, an integrator-based circuit structure, wherein the digital output on path 56 is generated by internal circuit structure including an integrator. On the other hand, second converter 55 may have internal circuitry which employs a successive approximation process to generate the digital output on path 57. The purpose for this is to provide additional redundancy in the system so that if a supply voltage spike, for example, damaged one converter, the different structure of the other might either not be affected, or might be affected in a way which will cause its output in case of failure to be distinct and different from that of the other converter. By adopting a structure of this type for the 55 system, a failure of either or both of converters 54 or can be more readily detected, and the chance of simultaneous failure of both converters 54 and 55 reduced. In this way, safety of operation in a burner device 12 can be enhanced.

Figure 8A:
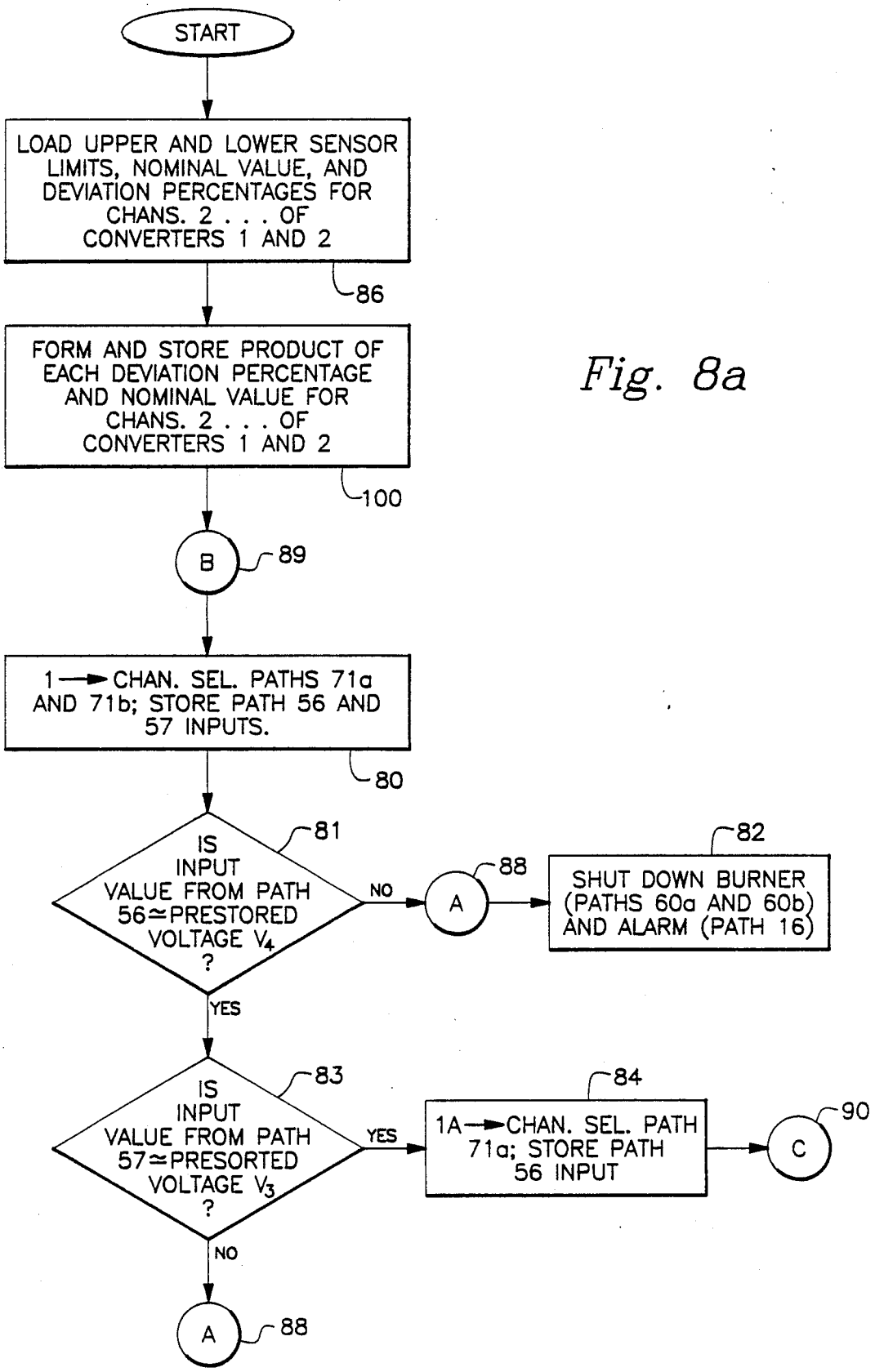
FIGS. 8A, 8B, and 8C in combination form a detailed flow chart of the safety testing software elements within the system.
Figure 8B:
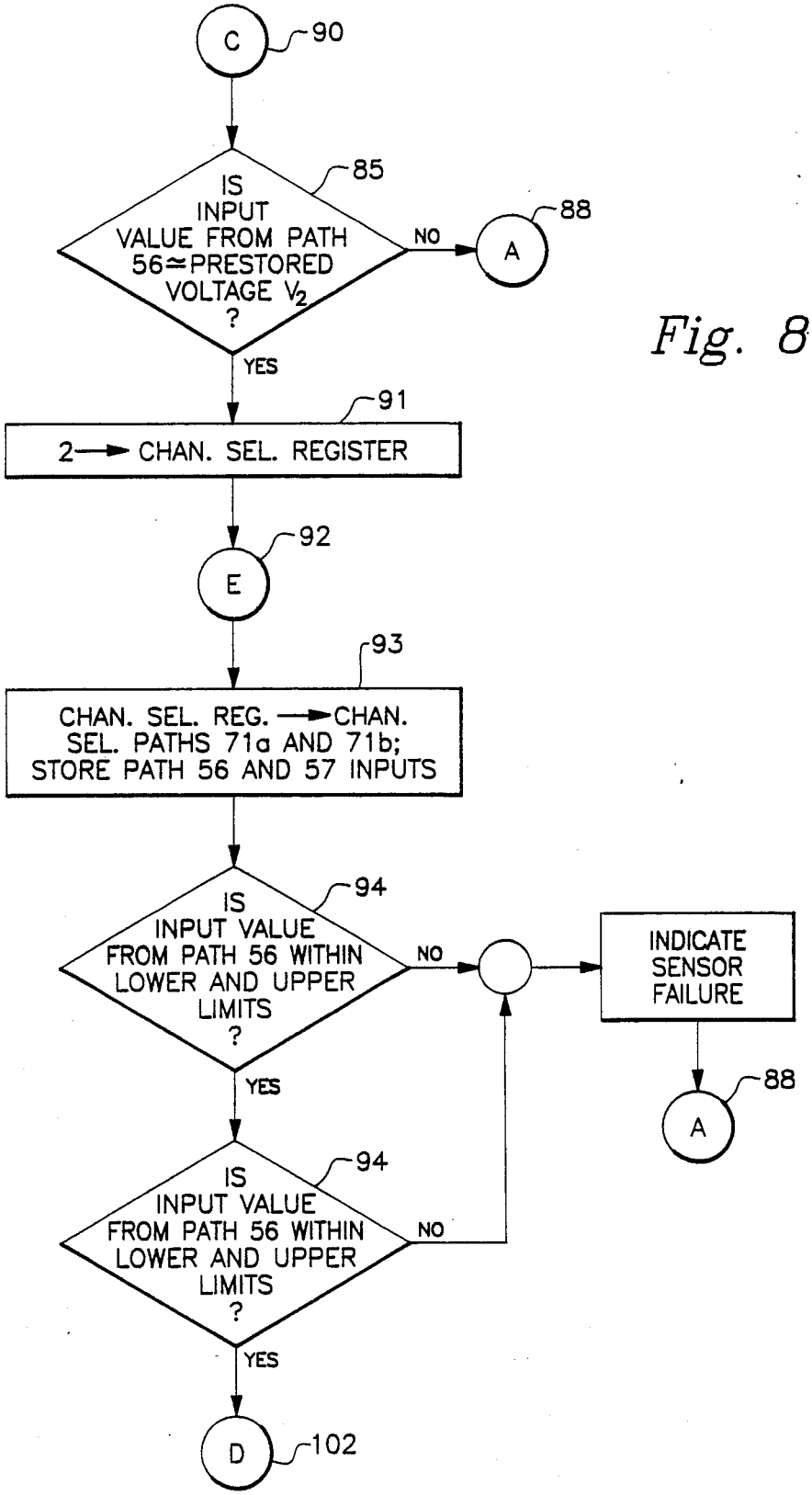
Figure 8C:
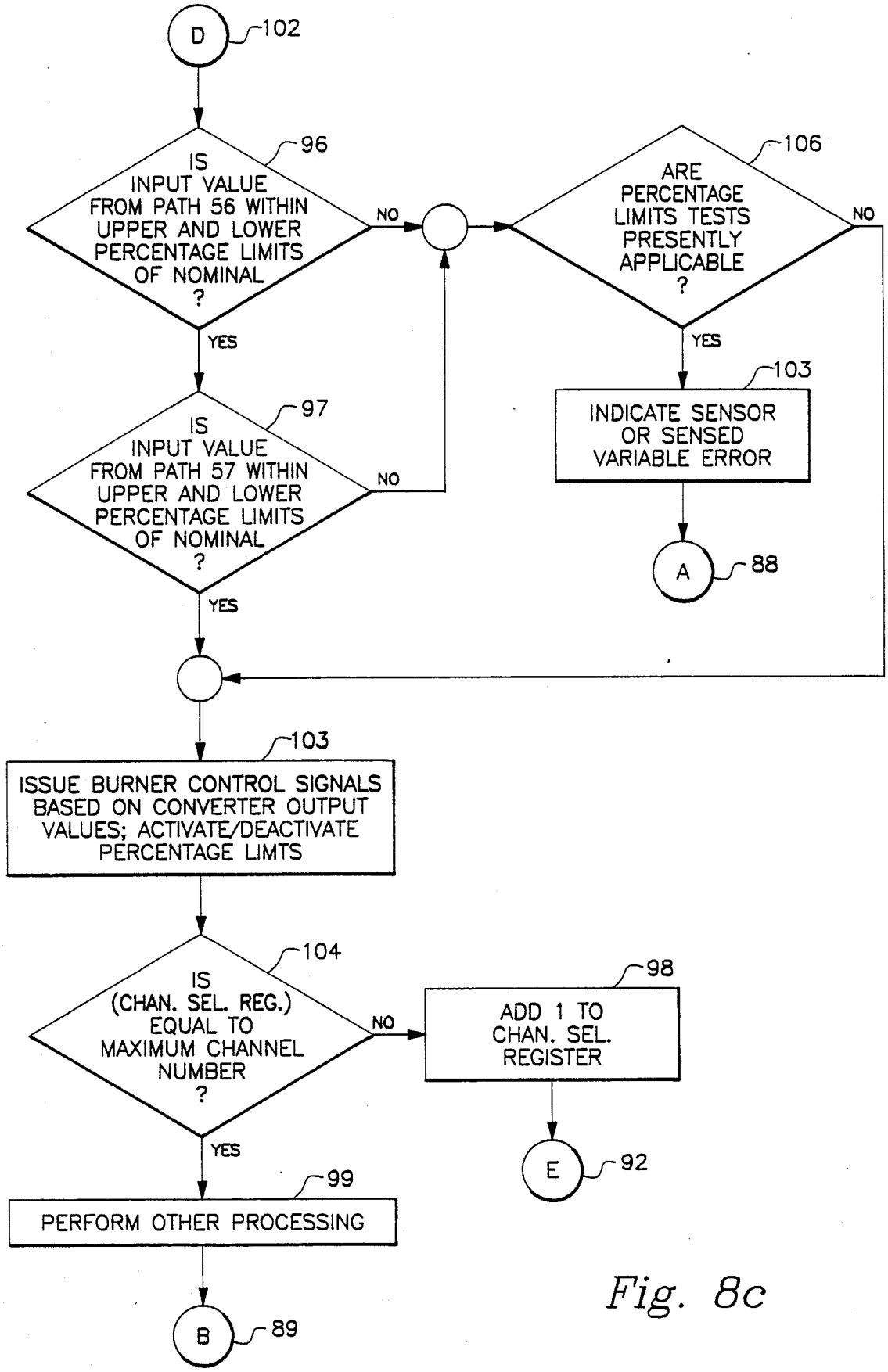

Operation of the apparatus of FIG. 7 is under the direction of a permanent program stored in microcomputer 51, of which the flow chart of FIGS. 8A, 8B, and 8C represents parts pertinent to this invention. It should be understood that each of the software elements of FIGS. 8A, 8B, and 8C represent actual physical structure forming part of a ROM of microcomputer 51. This physical structure in combination with the microcomputer internal structure forms apparatus to cause operation as delineated by the flow diagram of FIGS. 8A, 8B, and 8C.

Microcomputer 51 receives digital signals on paths 56 and 57 encoding the analog value of the voltage applied to the selected channel of each converter 54 and 55. The program of FIGS. 8A, 8B, and 8C is designed to continuously cycle selection from one to another of the input channels 1, 1A, 2, etc. for multiplexers 54*a* and 55*a*, performing the appropriate safety-related and other processing on the data received at the microcomputer 51 input channels connected to data paths 56 and 57. Such operation of microcomputer 51 starts as indicated in FIG. 8A with the series of instructions forming software function element 86, which causes the prestoring in a test range value table in microcomputer 51 memory of parameter values specific to the operation of the burner device 12 and to the sensors 17 and 18. The upper and lower limits of the values which each of the sensors 17 and 18 can provide under any conceivable normal operation are provided to the microcomputer 51 from an external source and are stored in its internal memory. A nominal value and an allowable deviation percentage which indicates either drift of the sensor output for some reason or drift in the operating parameters of the burner device are also provided for each sensor 17 and 18. These are device operating condition-dependent values; i.e. they are applicable when the burner 12 is active or operating. Element 86 associates these various values to each of the channels 2, 3, etc. of each of first and second converters 54 and 55. There is a way provided by which these sensor output parameters can be associated with the individual channel numbers to which their associated sensors are attached via the data paths 72*a* and 72*b*, and thus stored in the test range value table so as to be retrievable with reference to the channel number and converter involved.

Software element 100 provides for the entry in the test range value table of values reflecting each of the sensors 17 and 18 percentage deviation allowed during normal operating conditions of the burner 12. The deviation percentage and nominal value for each channel is multiplied and then added to the nominal value to designate the upper percentage deviation limit, and subtracted from the nominal value to form the lower percentage deviation limit from nominal. These products are then also stored in the test range value table to permit later retrieval with reference to the channel number and converter involved. It is, of course, possible to set these limits in ways other than by multiplication of percentage limits with the nominal value, but in our preferred embodiment, this provides greatest flexibility for changing these limits from installation to installation, or for modifying the tests if installation requirements change at a later time. In fact, any way of setting these narrower operating condition-dependent limits is acceptable. For simplicity's sake, these limits will be referred to as percentage limits in the discussion which follows.

Connector B 89 specifies the start of the comprehensive program loop which tests performance of the converters 54 and 55 and performs limit checks on the digital equivalents of the various sensor 17 and 18 outputs provided on paths 72*a* and 72*b*. Testing of converter performance starts with software function element 80 which represents the microcomputer 51 activities of placing channel address 1 on both channel select paths 71*a* and 71*b* of FIG. 7. In response to this, multiplexers 54*a* and 55*a* gate the voltages at their channels having addresses of 1 to the internal analog-to-digital conversion circuitry of converters 54 and 55. After the characteristic conversion time interval, converters 54 and 55 provide the digital value of the analog voltage levels on their respective input channels having addresses of 1, to microcomputer 51 input channels on data paths 56 and 57 respectively which then stores these digital values within its RAM.

Decision element 81 represents the microcomputer 51 activity of extracting a digital value for precision test voltage $V_3$ prestored within the microcomputer 51 ROM and comparing it to the digital comparison value of the voltage $V_3$ presented on path 56. This comparison preferably will not involve precise equality between the two digital values because variations within individual converter 54 and the value of $V_3$ resulting from temperature changes, condition of operating power, noise, variations in circuit component values, and other effects as well from system to system may cause minor imprecision in the digital value provided by converter 54. For one particular system it has been determined, for example, that these sources of error will inject uncertainty into all but the five most significant bits of converter 54. This results in an acceptable measurement error of approximately $\pm 1.6\%$. If the digital value on path 56 is within such an acceptable range of the prestored voltage value for $V_3$ as indicated by the "$\simeq$" (approximately equal) symbol, then control is transferred to decision element 83 as indicated by the "YES" legend. If the output value of the first converter 54 on path 56 is outside an acceptable range for the prestored voltage value $V_3$, the "NO" legend indicates that control is transferred through connector element A 88 to instructions comprising a software function element 82 which shuts down the burner device and provides an appropriate alarm to the operator. This represents the apparatus of FIG. 7 providing a burner shutdown signal on path 60*a* and the alarm signal on path 16.

If and when control is transferred to software decision element 83, this element performs a test similar to that performed by decision element 81, using the digital signal for voltage $V_4$ provided on data path 57 and the prestored value for precision test voltage $V_4$. If the value provided on path 57 is within an acceptable range of the internally stored digital value for voltage $V_4$ as indicated by the "$\simeq$" symbol, then control is transferred to software function element 84. If the path 57 value is outside the acceptable range, then control is transferred to shutdown function element 82 via connector element A 88.

These two tests check both converters 54 and 55 for proper operation and indicate whether the precision voltage supply 76 and the voltage dividers connected to it are operating properly. Furthermore, any drift in the voltage $V_{REF}$ supplied on path 73 to converters 54 and 55 will also be detected. Assuming both of these tests are passed, microcomputer 51 next executes the instructions of software function element 84.

Element 84 places address 1A on channel select path 71*a*, causing the voltage $V_2$ supplied by second precision voltage source 70 on path 74 to be presented for conversion from analog to digital by converter 54. In fact, address 1A will typically be a wholly numeric value; this notation is used to simplify the description. The digital value of $V_2$ is placed on data path 56 by converter 54 after the inherent conversion delay and stored by microcomputer 51. Software instruction execution then passes to decision element 85 on FIG. 8B via connector element C 90. Decision element 85 tests the value on path 56 against the prestored precise test voltage $V_2$ and, if this value falls outside of a preselected range around the prestored test voltage value $V_2$, causes control to again be transferred to function element 82 via connector element A 88, as indicated by the "NO" legend on that control flow path. If the test indicates an acceptable value for the output of converter 54, then the "YES" legend on the flow path from element 85 indicates that microcomputer 51 next executes instructions represented by activity element 91, to be discussed shortly.

Element 91 symbolizes the microcomputer 51 instructions which preset the index for the instruction loop which tests individual sensor 17 and 18 outputs for appropriate absolute maximum range and device operating condition-dependent limits.

As explained earlier, element 86 represents the instructions or activities which, in one way or another, preset in the microcomputer 51 memory the values of various parameters against which are tested these digital values of the output of the sensors 17 and 18 connected to the channels having addresses 2, 3, . . . etc. of the inputs for multiplexers 54*a* and 55*a*. These test range parameters are of two types. The first type of values are the absolute upper and lower limit values for each of the sensors 17 and 18, and are thus system limits. The second type are permissible deviation percentages for each of the sensors 17 and 18, and are thus device operating condition-dependent limits. There are thus four different of these limit values for each of the sensors 17 and 18 connected to the channels of multiplexers 54*a* or 55*a* having addresses 2, 3, 4, etc. and receiving the analog sensor 17 or 18 signals on one of the group of paths 72*a* or 72*b*. Some or all of these limits may be inserted by the technician while configuring the system during installation or derived from values so provided. It is also possible that some installations will have some or all of these values inserted at the factory during the manufacturing process or derived from such values.

These values permit a two-stage process for testing individual sensor 17 and 18 outputs. In the first stage, the sensor output is simply tested to fall between the upper and lower absolute sensor limits. These values reflect the maximum possible range of the sensor 17 or 18 involved. It is also the case that for many of the sensors 17 and 18 and the parameter value in the device 12 which they sense during certain operating conditions, that nominal values and deviations therefrom can be attached which vary from installation to installation. For example, if the device 12 is a fuel burner, acceptable fuel flow rate is likely to vary depending on the burner capacity. Thus a nominal value for fuel flow rate may be established while combustion occurs and a flow rate of zero when combustion is not occurring. Since this device operating condition-dependent nominal value can vary from one installation to another, deviation percentages are included which, when applied to the nominal value, will create a range whose absolute width varies depending on the magnitude of the nominal value.

Thus at this testing stage, the activities of function element 100, which previously formed the products of the upper and lower deviation percentages and the nominal value for each sensor and stored these values for future use in the test range value table ordered according to channel address number, allow the testing sequence to be described to proceed without interruption. By merely entering the table with the channel number initialized by the instructions of function element 91, the test range values provided for each sensor may be retrieved when needed.

It is useful to establish the channel select address register 51*a* within microcomputer 51 mentioned earlier whose content is the desired channel number to be transmitted on channel select path 71*a* to provide the address of the multiplexer 54*a* and 55*a* input channels supplying the analog voltages from the sensors 17 and 18 to be converted to digital format. To reduce the amount of instructions required, this function is performed by a simple software loop which iteratively increments the selected channel number in register 51*a* and receives the associated digital values of sensor 17 and 18 outputs on paths 56 and 57. Accordingly, a connector element E 92 is provided as the entry for each pass through this instruction loop. Software function element 91 presets the index variable for this loop by storing a numeral 2 in channel select register 51*a*, 2 being the address for the low order input channels for multiplexers 54*a* and 55*a*.

At the start of this loop, the contents of the channel select register 51*a* is transferred via output channels in microcomputer 51 on paths 71*a* and 71*b* to converters 54 and 55. In response to this input address, the multiplexers 54*a* and 55*a* of each gates the voltages provided by the sensors 17 and 18 connected to channel 2 of each to the converters 54 and 55 respectively to allow conversion from analog to digital. After the converter delay, the digital equivalents of these sensor voltages are provided on paths 56 and 57 to microcomputer 51. The digital data present on paths 56 and 57 may further be stored in convenient cells of the microcomputer 51 RAM by the instructions represented by function element 93. Next, the instructions represented by test element 94 retrieve the lower and upper absolute sensor limit values stored in the test range value table using the contents of channel select address register 51*a* as the index. The digital value of the sensor output presented on path 56 is tested to be within these lower and upper absolute sensor limits retrieved from the test range value table. If it is not within these limits, then control is transferred as indicated by the path labeled "NO" to function element 101 which identifies the likely problem as being sensor failure and then transfers further operation to connector element A 88, leading to burner shutdown and an alarm indication to the operator.

If, on the other hand, the input value to microcomputer 51 on path 56 is within these specific lower and upper limits for the sensor 17, then control is transferred to the instructions represented by test element 95. Test element 95 represents the instructions which extract the lower and upper absolute sensor limits for the sensor 18 connected to input channel 2 of multiplexer 55*a* and test the digital value of this sensor's analog voltage. If the value of the digitized sensor 18 output falls within the absolute upper and lower limits established for it and stored in the test range value table, then instruction execution passes to the control flow path of connector element D 102 on FIG. 8C. If not, then the instructions of element 101 are executed as previously described for element 94.

If the output of the second converter 55 has passed the test indicated by decision element 95, then a further test is performed on the sensor 17 digital value output on path 56 as symbolized by decision element 96 on FIG. 8C. The products of each deviation percentage and nominal value formed by the instructions of function element 100 for sensors 17 and 18, and stored in the test range value table, are extracted for each individual sensor 17 and 18 using the contents of channel select register 51*a* as the index. Decision element 96 tests the value on path 56 to be within these upper and lower percentage limits of nominal. If the value is not within these limits, the "NO" legend implies the instructions symbolized by decision element 106 are next executed.

It is possible that the operating status of burner device 12 may be such that failure of these narrower limits does not indicate a malfunction. For example, if burner 12 is not firing, then fuel flow rate should be zero (or very low if a pilot is being maintained), and the (narrower) percentage limits on the sensor output for fuel flow do not apply. Typically, these limits also should not apply the first set of passes through this loop after start-up because operation is only being established at this time. The microcomputer 51 itself establishes the applicability of these narrower limits according to the control conditions imposed on burner device 12 by signals on paths 60*a* and 60*b*. If the percentage limits test is inapplicable, instruction execution then commences with those represented by function element 103.

If the percentage limits test is applicable, then the element 106 instructions transfer control to the instructions of function element 105 to provide an appropriate indication of the likely error as being either sensor drift or actual malfunction of the burner device 12. Then control is transferred to connector element A 88 for burner shutdown and an alarm signal to the operator.

Assuming this previous test symbolized by decision element 96 is satisfactorily passed, then the "YES" control path indication thereon symbolizes execution next of the instructions which decision element 97 represents. This test is identical to that for decision element 96 except that the output of second converter 55 on path 57 is tested against the upper and lower percentage limits of nominal which have been stored in the test range value table for the sensor 18 connected to the multiplexer 55*a* input channel whose number is stored in the channel select register 51*a*. Failure of this test also causes instruction execution to transfer to the instructions symbolized by decision element 106.

If the instructions symbolized by test element 97 are reached for execution and successfully performed, then it is reasonable to assume that the sensors 17 and 18 have accurately measured and provided the various parameters of burner 12 performance. It is therefore acceptable to continue and modify operation of burner device 12 as the internal burner control algorithm of the instructions of element 103 stored in the microcomputer 51 memory specifies, based on the various sensor 17 and 18 values carried on paths 56 and 57. At this time, the percentage limits tests can be activated or deactivated for each of the various sensors, depending on the operating status of burner device 12. This simply reflects the situation that different limits are applicable depending on which sensors are involved and what the burner device 12 has been directed to do at the instant the percentage limit tests of decision elements 96 and 97 are performed. It should be understood that burner operation modification may not be initiated until a group of sensor values have been all converted to digital and tested. This limitation is well known in the art and further is beyond the scope of this description.

After whatever sensor signal processing is appropriate, the instructions represented by decision element 104 are eventually executed to determine whether another pass through this sensor output test loop is required. If the contents of channel select register 51*a* is not equal to the maximum channel number (typically 7) for multiplexers 54*a* and 55*a*, then control is transferred to function element 98, whose instructions cause 1 to be added to the channel select register 57*a* and control transferred back through connector element E 92 to function element 93 in FIG. 8B. The instructions for the various limit value retrievals and sensor output values are then performed for the sensors 17 and 18 connected to the input channels of multiplexers 54*a* and 55*a* whose addresses are 3. This pattern continues until the contents of the channel address register 51*a* is equal to the maximum channel number for the multiplexers 54*a* and 55*a*, at which time control is transferred to function element 99 which symbolizes the instructions which accomplish other needed processing functions and activities of microcomputer 51 to control burner 12 operation. After these instructions have all been executed, then control is transferred to the instructions which function element 80 on FIG. 8A represents, as indicated by the flow to connector element B 89.

In this way, microcomputer 51 receives the digital equivalents of the analog outputs from the various sensors 17 and 18 whose outputs, to a very high degree of certainty, accurately reflect the levels of the various operating parameters of burner device 12. It should be understood that the order of many of these tests and activities is arbitrary. Only those functions whose occurrence or execution is necessary for the proper action of later-occurring functions must be performed in the order specified. For example, the various tests for converter 54 and 55 accuracy should be performed before the sensors 17 and 18 are tested for being within limits. This isolates the cause of a sensed inaccuracy and allows the operator to make repairs or adjustments more rapidly and easily. In general, critical sequencing of these software elements are stated in or easily inferable from the preceding description.

A preferred embodiment of the present invention has been specifically disclosed and is clearly subject to modification within the knowledge of one skilled in this art. The applicants wish to be limited in the scope of their invention solely by the scope of the appended claims.

The embodiments of an invention in which an exclusive property or right is claimed are defined as follows:

1. In a control system for providing a control signal for controlling the activity of a physical device whose operating condition can be derived from the output of a plurality of sensors each sensing a preselected physical quantity associated with the device and each providing an analog voltage signal whose magnitude is indicative of the physical quantity sensed by it, improved apparatus for testing system elements for operation according to design requirements and for issuing an alarm signal responsive to operation outside of design requirements, including (a) first and second analog to digital converters, each having at least first and second multiplexed analog voltage input channels, the channels for each converter respectively having predetermined unique first and second addresses, and each converter receiving a sensor signal at its second channel, each said converter further receiving channel select signals in which are encoded channel addresses and supplying responsive to the channel select signal a digital output signal encoding the magnitude of the analog signal present at the channel whose address is encoded in the channel select signal;

(b) a first reference voltage source providing a voltage to the first and second converters' first input channels, said provided voltages having predetermined precise values; and (c) microcomputer means prestoring the digital value of the voltage provided by the first reference voltage source and which microcomputer means receiving the outputs of the first and second converters, for during a first predetermined time providing to each converter a channel select signal encoding the predetermined first input channel address of each, for storing the output from each converter during the first predetermined time, for testing the output of each converter for agreement with the prestored value for the first source's voltage supplied to that converter, and for issuing the alarm signal responsive to failure of the prestored value of the voltage provided by the first reference voltage source to agree with the output of the first or second converter.

2. The improvement of claim 1, further including a second reference voltage source providing a voltage having a precise predetermined level; wherein the first converter further includes a third input channel receiving the voltage from the second voltage source and having a predetermined unique third address; said microcomputer means digitally prestoring the value of the voltage provided by the second reference voltage source for during a second predetermined time providing to the first converter a channel select signal encoding the third predetermined input channel address, for storing the output from the first converter during the first predetermined time, for testing the output of the first converter for agreement with the prestored value for the second source's voltage, and for issuing the alarm signal responsive to failure of the prestored value of the voltage provided by the second reference voltage source to agree with the output of the first converter.

3. The improvement of claim 1, wherein the first reference voltage source comprises (a) a voltage supply having a precisely predetermined output voltage level; and (b) first and second voltage divider circuits connected to the output of the voltage supply, the first divider circuit supplying a precisely predetermined voltage level to the first converter's input channel having the predetermined first address and the second divider circuit supplying a precisely predetermined voltage level to the second converter's input channel having the first predetermined address;

and wherein the microcomputer means further comprises means prestoring the digital values of the voltages provided by the first and second voltage divider circuits for testing the outputs of the first and second converters for agreement respectively with the prestored values for the first and second divider circuits' predetermined voltage levels, and for issuing the alarm signal responsive to failure of the prestored values of the voltages provided by the first and second voltage divider circuit voltage levels to respectively agree with the output of the first and second converter outputs.

4. The improvement of claim 2, wherein the binary digital value of the voltage provided by the first voltage source has digits differing in a predetermined number of sequential high order digits from that of the corresponding high order digits of the binary digital value of the voltage provided by the second voltage source.

5. The control system of claim 2, wherein the first converter has a predetermined full scale binary digital output comprising a sequence of consecutive high order binary ones corresponding to a predetermined voltage level input, and wherein the sum of the voltages provided by the first and second voltage sources approximately equals the predetermined voltage level input to which corresponds the first converter's predetermined full scale output.

6. The improvement of claim 5, wherein a predetermined number of high order bits of the binary digital value of the voltage provided by the first voltage source are the complements of the corresponding high order bits of the binary digital value of the voltage provided by the second voltage source.

7. The control system of claim 1, wherein the first converter includes circuitry having an integrator-based structure performing the analog to digital conversion and the second converter includes circuitry having a successive approximation-based structure performing the analog to digital conversion.

8. The control system of claim 1, wherein the second converter includes circuitry having an integrator-based structure performing the analog to digital conversion and the first converter includes circuitry having a successive approximation-based structure performing the analog to digital conversion.

9. In a control system for providing a control signal for controlling the activity of a physical device whose operating condition can be derived from the output of at least one sensor sensing a preselected physical quantity associated with the device and each sensor providing an analog voltage signal whose magnitude is indicative of the physical quantity sensed by it, improved apparatus for testing system elements for operation according to design requirements and for issuing an alarm signal responsive to operation outside of design requirements, including (a) at least a first analog to digital converter having an analog voltage input channel receiving a sensor signal thereat, said converter supplying a digital output signal encoding the magnitude of the analog signal present at the input channel;

(b) microcomputer means receiving the output of the converter and further digitally prestoring (i) first and second values respectively specifying predetermined lower and upper limits for the output from the first converter and (ii) narrower device operating condition-dependent lower and upper limits for the outputs from the converter, for testing the output of the converter to fall within both the range defined by the device operating condition-dependent lower and upper limits and the range defined by the first and second values, for issuing the alarm signal upon failure of either of the tests, and for issuing a control signal which is a function of the converter output signal otherwise.

10. The improvement of claim 9, wherein the microcomputer means further digitally prestores (i) a nominal value for the output of each sensor, and (ii) allowable lower and upper deviation percentages from the nominal value for the output of each sensor, and includes means for multiplying the nominal value for the output of each sensor by each of the lower and upper deviation percentages for the sensor, for storing each of the products of the lower percentage and the nominal value of a sensor as a device operating condition-dependent lower limit for the outputs from the converter, and for storing each of the products of the upper percentage and the nominal value of a sensor as a device operating condition-dependent upper limit for the outputs from the converter.

11. The improvement of claim 9, wherein the microcomputer means includes means for receiving from an operator at least one of the digitally prestored values.

12. The improvement of claim 9, wherein the microcomputer testing means includes the function of issuing an alarm signal indicating a defective sensor responsive to the output of the converter falling outside the range defined by the first and second values.

13. The improvement of claim 9, wherein the microcomputer testing means includes the function of issuing an alarm signal indicating sensor output drift responsive to the output of the converter falling outside the range defined by the products of the lower percentage and the nominal value for the sensor output and the upper percentage and the nominal value for the sensor output.

14. The improvement of claim 9, wherein the microcomputer testing means includes means for establishing a plurality of operating conditions for the device and selectively providing the alarm signal responsive to a sensor value falling outside of the device operating condition-dependent lower and upper limits for the outputs from the converter, according to predetermined ones of the microcomputer-established operating conditions for the device.

* * * * *